US007205513B2

(12) United States Patent
Pan et al.

(10) Patent No.: US 7,205,513 B2
(45) Date of Patent: Apr. 17, 2007

(54) INDUCTION HEATED FUSER AND FIXING MEMBERS

(75) Inventors: David H. Pan, Rochester, NY (US); Gerald A. Domoto, Briarcliff Manor, NY (US); Donald M. Bott, Rochester, NY (US); Jeremy C. De Jong, Webster, NY (US); Nicholas P. Kladias, Flushing, NY (US)

(73) Assignee: Xerox Corporation, Stamford, CT (US)

( * ) Notice: Subject to any disclaimer, the term of this patent is extended or adjusted under 35 U.S.C. 154(b) by 81 days.

(21) Appl. No.: 11/166,271

(22) Filed: Jun. 27, 2005

(65) Prior Publication Data

US 2006/0289481 A1 Dec. 28, 2006

(51) Int. Cl.
*H05B 6/14* (2006.01)
*G03G 15/20* (2006.01)

(52) U.S. Cl. ..... 219/619; 219/634; 219/649; 219/671; 399/328; 399/330

(58) Field of Classification Search ..... 219/634, 219/619, 618, 649, 671; 399/328–338
See application file for complete search history.

(56) References Cited

U.S. PATENT DOCUMENTS 3,952,798 A 4/1976 Jacobson et al.
4,257,699 A 3/1981 Lentz
4,272,179 A 6/1981 Seanor
4,373,239 A 2/1983 Henry et al.
4,511,778 A 4/1985 Takahashi et al.
4,765,859 A 8/1988 Heath et al.
5,017,432 A 5/1991 Eddy et al.
5,049,444 A 9/1991 Bingham et al.
5,061,965 A 10/1991 Ferguson et al.
5,166,031 A 11/1992 Badesha et al.
5,281,506 A 1/1994 Badesha et al.
5,332,641 A 7/1994 Finn et al.
5,366,772 A 11/1994 Badesha et al.
5,370,931 A 12/1994 Fratangelo et al.
5,501,881 A 3/1996 Fuller et al.
5,512,409 A 4/1996 Henry et al.
5,526,103 A 6/1996 Kato et al.
5,666,627 A 9/1997 Yamaguchi
5,679,463 A 10/1997 Visser et al.
5,682,580 A 10/1997 Iwama et al.
5,713,069 A 1/1998 Kato
5,729,813 A 3/1998 Eddy et al.
5,752,148 A 5/1998 Yoneda et al.
5,768,673 A 6/1998 Morigami
5,794,096 A 8/1998 Okabayashi
5,822,669 A 10/1998 Okabayashi et al.
5,832,354 A 11/1998 Kouno et al.
5,839,043 A 11/1998 Okabayashi et al.
5,854,957 A 12/1998 Morikawa
5,870,660 A 2/1999 Ito et al.
5,911,094 A 6/1999 Tsujimoto et al.

(Continued)

*Primary Examiner*—Philip H. Leung
(74) *Attorney, Agent, or Firm*—Oliff & Berridge, PLC

(57) ABSTRACT

A coated member includes a substrate and a coating layer over the substrate where the coating layer includes at least one of ferromagnetic and magnetic particles dispersed in a binder. The member, which is suitable for use in an electrostatographic printing process, can be in the form of a fuser member, a fixing member, a pressure roller, or a release agent donor member.

17 Claims, 1 Drawing Sheet

U.S. PATENT DOCUMENTS 5,915,147 A 6/1999 Kouno et al.
5,928,551 A 7/1999 Okabayashi
5,935,712 A 8/1999 Tan et al.
5,953,223 A 9/1999 Kato et al.
5,998,033 A 12/1999 Tan et al.
6,007,657 A 12/1999 Eddy et al.
6,021,303 A 2/2000 Terada et al.
6,026,273 A 2/2000 Kinouchi et al.
6,035,174 A 3/2000 Ito et al.
6,037,576 A 3/2000 Okabayashi et al.
6,055,403 A 4/2000 Watanabe
6,078,781 A 6/2000 Takagi et al.
6,087,641 A 7/2000 Kinouchi et al.
6,090,491 A 7/2000 Tan et al.
6,097,926 A 8/2000 Takagi et al.
6,114,041 A 9/2000 Tan et al.
6,122,477 A 9/2000 Parker et al.
6,137,985 A 10/2000 Kinouchi et al.
6,154,629 A 11/2000 Kinouchi et al.
6,159,588 A 12/2000 Eddy et al.
6,169,871 B1 1/2001 Higaya
6,175,699 B1 1/2001 Kato et al.
6,195,525 B1 2/2001 Maeyama
6,246,035 B1 6/2001 Okuda
6,246,036 B1 6/2001 Tsujimoto et al.
6,252,212 B1 6/2001 Takagi et al.
6,253,055 B1 6/2001 Badesha et al.
6,255,633 B1 7/2001 Takagi et al.
6,262,404 B1 7/2001 Higaya et al.
6,278,852 B1 8/2001 Hayashi
6,292,647 B1 9/2001 Ishida
6,292,648 B1 9/2001 Higaya et al.
6,320,168 B1 11/2001 Kimata et al.
6,321,046 B1 11/2001 Kikuchi et al.
6,327,456 B1 12/2001 Higata
6,336,027 B1 1/2002 Sakai et al.
6,337,969 B1 1/2002 Takagi et al.
6,346,800 B1 2/2002 Mano et al.
6,349,187 B2 2/2002 Hayashi
6,366,757 B1 4/2002 Tsujimoto et al.
6,372,399 B1 4/2002 Tomura
6,373,036 B2 4/2002 Suzuki
6,377,778 B1 4/2002 Kikuchi et al.
6,395,444 B1 5/2002 Riehle et al.
6,415,128 B1 7/2002 Takagi et al.
6,427,056 B1 7/2002 Kawano et al.
6,430,386 B2 8/2002 Okubo et al.
6,438,335 B1 8/2002 Kinouchi et al.
6,449,457 B2 9/2002 Samei et al.
6,455,824 B2 9/2002 Takagi et al.
6,463,252 B2 10/2002 Omoto et al.
6,495,810 B2 12/2002 Takagi et al.
6,498,906 B2 12/2002 Kimoto et al.
6,507,008 B2 1/2003 Nakayama et al.
6,518,552 B2 2/2003 Takagi et al.
6,522,846 B2 2/2003 Kinouchi et al.
6,531,689 B2 3/2003 Ohishi et al.
6,544,708 B2 4/2003 Komoto et al.
6,545,255 B2 4/2003 Sato et al.
6,577,839 B2 6/2003 Samei
6,583,393 B1 6/2003 Ota
6,584,298 B2 * 6/2003 Omoto et al. ..... 399/330
6,591,082 B2 7/2003 Samei et al.
6,608,289 B2 8/2003 Tsuruya
6,642,488 B2 11/2003 Takagi et al.
6,643,476 B1 11/2003 Kinouchi et al.
6,643,491 B2 11/2003 Kinouchi et al.
6,646,239 B2 11/2003 Takagi et al.
6,660,979 B2 12/2003 Takagi et al.
6,661,991 B2 12/2003 Naito et al.
6,687,481 B2 2/2004 Watanabe et al.
6,687,482 B2 2/2004 Maeda et al.
6,704,536 B2 3/2004 Nakayama
6,721,530 B2 4/2004 Hirst et al.
6,724,999 B2 4/2004 Kikuchi et al.
6,725,000 B2 4/2004 Takagi et al.
6,725,010 B1 4/2004 Parker
6,753,515 B2 6/2004 Miyahara et al.
6,763,204 B2 7/2004 Kondo et al.
6,763,206 B2 7/2004 Kinouchi et al.
6,782,216 B2 8/2004 Suzuki
6,813,456 B2 11/2004 Kinouchi et al.
6,816,688 B2 11/2004 Takano
6,818,871 B2 11/2004 Ogasawara et al.
6,847,019 B2 1/2005 Yokozeki et al.
6,849,838 B2 2/2005 Shimizu et al.
6,850,728 B2 2/2005 Yokozeki et al.

* cited by examiner

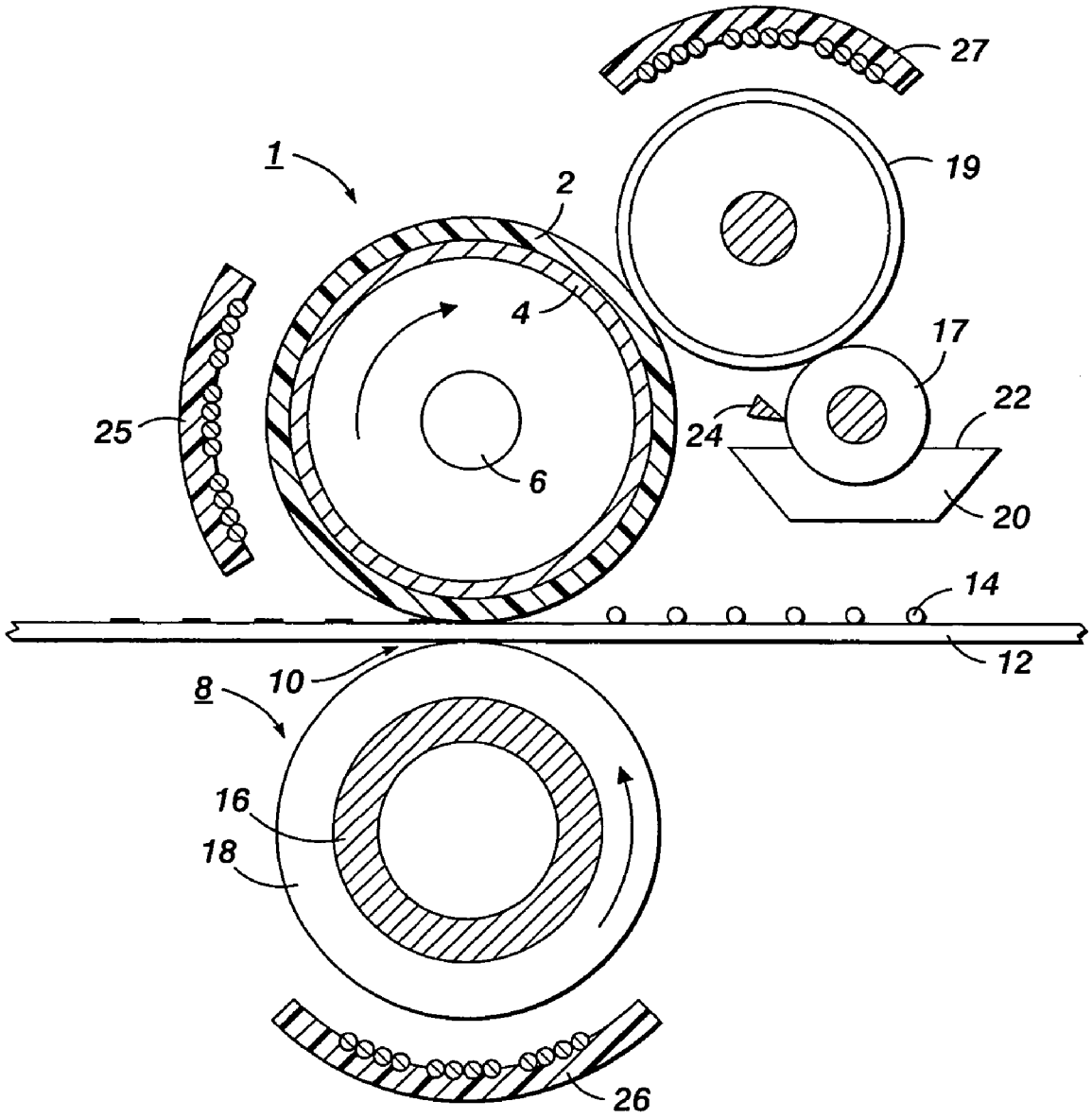
27
19
1
2
4
17
22
25
24
6
20
14
12
10
8
16
18
26

INDUCTION HEATED FUSER AND FIXING MEMBERS

BACKGROUND

This disclosure relates to fuser or fixing members, and processes for making such fuser and fixing members. In particular, this disclosure relates to processes for making such fuser and fixing members, or other members, which are induction heated and where at least a layer of the member includes ferromagnetic or magnetic particles that enable induction heating of the member. This disclosure also relates to developing apparatuses using such fusing and fixing members.

In a typical electrostatographic printing apparatus, a light image of an original to be copied is recorded in the form of an electrostatic latent image upon a photosensitive member and the latent image is subsequently rendered visible by the application of electroscopic thermoplastic resin particles, which are commonly referred to as toner. The visible toner image is then in a loose powdered form and can be easily disturbed or destroyed. The toner image is usually fixed or fused upon a support, which may be a photosensitive member itself or other support sheet such as plain paper, transparency, specialty coated paper, or the like.

The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, thermoplastic resin particles are fused to the substrate by heating to a temperature of between about 90° C. to about 160° C. or higher, depending upon the softening range of the particular resin used in the toner. It is not desirable, however, to raise the temperature of the substrate substantially higher than about 200° C. because of the tendency of the substrate to discolor at such elevated temperatures particularly when the substrate is paper.

Several approaches to thermal fusing of electroscopic toner images have been described in the prior art. These methods include providing the application of heat and pressure substantially concurrently by various means, including a roll pair maintained in pressure contact, a belt member in pressure contact with a roll, and the like. Heat may be applied by heating one or both of the rolls, plate members or belt members. The fusing of the toner particles generally takes place when the proper combination of heat, pressure and contact time are provided. The balancing of these parameters to bring about the fusing of the toner particles is well known in the art, and they can be adjusted to suit particular machines, process conditions, and printing substrates.

During operation of a fusing system in which heat is applied to cause thermal fusing of the toner particles onto a support, both the toner image and the support are passed through a nip formed between the roll pair, or plate and/or belt members. The concurrent transfer of heat and the application of pressure in the nip effect the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus, increasing the background or interfering with the material being copied there. The so called "hot offset" occurs when the temperature of the toner is raised to a point where the toner particles liquefy and a splitting of the molten toner takes place during the fusing operation with a portion remaining on the fuser member.

The hot offset temperature or degradation of the hot offset temperature is a measure of the release property of the fuser roll, and accordingly it is desired to provide a fusing surface that has a low surface energy to provide the necessary release. To ensure and maintain good release properties of the fuser roll, it has become customary to apply release agents to the fuser members to ensure that the toner is completely released from the fuser roll during the fusing operation. Typically, these materials are applied as thin films of, for example, silicone oils to prevent toner offset. In addition to preventing hot offset, it is desirable to provide an operational latitude as large as possible. By operational latitude it is intended to mean the difference in temperature between the minimum temperature required to fix the toner to the paper, the minimum fix temperature, and the temperature at which the hot toner will offset to the fuser roll, the hot offset temperature.

Generally, fuser and fixing rolls are prepared by applying one or more layers to a suitable substrate. For example, cylindrical fuser and fixer rolls are typically prepared by applying an elastomer or a fluoroelastomer layer, with or without additional layers, to an aluminum core. The coated roll is then heated in a convection oven to cure the elastomer or fluoroelastomer material. Such processing is disclosed in, for example, U.S. Pat. Nos. 5,501,881, 5,512,409 and 5,729,813, the entire disclosures of which are incorporated herein by reference.

In use, important properties of the fuser or fixer members include thermal conductivity and mechanical properties such as hardness. Thermal conductivity is important because the fuser or fixer member must adequately conduct heat, to provide the heat to the toner particles for fusing. Mechanical properties of the fuser or fixer member are important because the member must retain its desired rigidity and elasticity, without being degraded in a short period of time. In order to increase the conductivity of the fuser or fixer members, it has been conventional to add quantities of conductive particles as fillers, such as metal oxide fillers. In order to provide high thermal conductivity, the loading of the filler must be high. However, increasing the loading of the filler tends to adversely affect mechanical properties of the coating layer, making the member harder and more prone to wear. For example, conventional metal oxides such as aluminum, iron, copper, tin, and zinc oxides are disclosed in U.S. Pat. Nos. 6,395,444, 6,159,588, 6,114,041, 6,090,491, 6,007,657, 5,998,033, 5,935,712, 5,679,463, and 5,729,813. These metal oxide filler materials, at loadings up to about 60 wt %, provide thermal conductivities of from about 0.2 to about 1.0 $Wm^{-1}K^{-1}$. However, the loading amount of the filler must be limited due to the increased hardness provided by high loading levels.

A problem with conventional fusing members, however, is the high thermal conductivity mismatch between the substrate layer and the outer layer. Heat generation in conventional fusing subsystems is generally accomplished by using heaters inside the fuser member, such as lamps located inside the fuser roll. In these subsystems, the centrally located lamps heat the fuser core, which is usually a metal core, which then transfers the heat to the coated layer(s) of elastomer, thermoplastic, or the like. Thus, in order to heat the outer surface of the fuser roll, the centrally located lamps must first heat the fuser roll substrate to a high temperature, and that heat must subsequently be transferred through the substrate and through the relatively thick applied outer layers, to reach the fuser member surface. However, the organic material coating layers applied over the substrate have orders of magnitude lower thermal conductivity values as compared to the metal substrate layer, thereby significantly limiting the heat transfer rate from the substrate layer to and through the organic outer layers. This limited heat transfer rate also results in poor temperature uniformity on the outer surface of the fuser member, particularly in running papers of different widths. Another problem with the low thermal conductivity coatings is the surface temperature drop and fluctuation of the heat roll in multi-page print runs.

One approach to address the above problems, is to use inductive heating of the fuser member layers. For example, a modified fuser member has been proposed that utilizes an inductive heating and heat pipe approach, where one end of fuse roll is heated, and that heat is transferred longitudinally down the length of the member by a heat pipe. This approach simplifies the geometry of the fuser subsystem, and helps to solve the problems of temperature non-uniformity and warm-up time. Heating is primarily accomplished through the highly thermally conducting heat pipe. However, the relatively low thermal conductivity of the outer organic layers still poses a barrier to heat transfer, particularly in thick, multi-layer coatings.

U.S. Pat. No. 6,078,781 discloses a fixing device that includes a first roller that is made of a conductive material and is rotated and driven; a second roller that is in contact with the first roller in the pressed state; and an induction heating unit that is arranged at the first roller side and concentrates the induction heating to the nip portion of the first roller. The induction heating unit of the fixing device is made of a high permeable material, has a core that is open at the surface opposite to the first roller and a coil wound round the core and generates magnetic flux on the core when high frequency current is supplied to the core and has a high projecting portion so that a part of the core closes the first roller.

Accordingly, there is a need in the art for improved filler materials for fuser and fixer members. Specifically, there is a need for improved filler materials that will provide higher thermal conductivity, but of a type or at loading levels that provide lower hardness to the member. There is also a need for improved filler materials that improve other mechanical properties of the member, such as longer life performance.

SUMMARY

This disclosure addresses some or all of the above problems, and others, by providing fuser or fixer members that are induction heated and where at least a layer of the member includes ferromagnetic or magnetic particles that enable induction heating of the member. Such inclusion enhances the thermal conductivity of the member and allows for more efficient and more uniform inductive heating of the member. In some embodiments, the inclusion of ferromagnetic or magnetic particles allows for self-regulation of the heating temperature, even without external control.

More particularly, in embodiments, the present disclosure provides a coated member, comprising:

a substrate; and a coating layer over said substrate, wherein said coating layer comprises at least one of ferromagnetic and magnetic particles dispersed in a binder.

The present disclosure also provides a process for making a coated member, comprising:

providing a substrate; and coating the substrate with a coating layer comprising at least one of ferromagnetic and magnetic particles dispersed in a binder.

BRIEF DESCRIPTION OF THE DRAWINGS

These and other advantages and features of this disclosure will be apparent from the following, especially when considered with the accompanying drawings, in which:

The FIGURE is a sectional view of a fuser system that may use the fuser member according to the present disclosure.

DETAILED DESCRIPTION OF PREFERRED EMBODIMENTS

According to embodiments, fusing and fixing members, and the like, are provided. In embodiments, the various members are made according to any of the various known processes in the art, except that ferromagnetic and/or magnetic particles that enable induction heating of the member are incorporated into the member, in place of or in conjunction with conventional filler materials, to provide thermal conductivity and other properties.

A typical fuser member of embodiments is described in conjunction with a fuser assembly as shown in the FIGURE where the numeral 1 designates a fuser roll comprising an outer surface 2 upon a suitable base member 4. The base member 4 can be a hollow cylinder or core fabricated from any suitable metal such as aluminum, anodized aluminum, steel, nickel, copper, and the like. Alternatively, the base member 4 can be a hollow cylinder or core fabricated from non-metallic materials, such as polymers or the like, or can be an endless belt (not shown) of similar construction. As shown in the FIGURE, the base member 4 can optionally include a suitable heating element 6 disposed in the hollow portion thereof and that is coextensive with the cylinder. Backup or pressure roll 8 cooperates with the fuser roll 1 to form a nip or contact arc 10 through which a copy paper or other substrate 12 passes, such that toner images 14 on the copy paper or other substrate 12 contact the outer surface 2 of fuser roll 1. As shown in the FIGURE, the backup roll 8 has a rigid steel core 16 with a soft surface layer 18 thereon, although the assembly is not limited thereto. Sump 20 contains a polymeric release agent 22 which may be a solid or liquid at room temperature, but is a fluid at operating temperatures.

The FIGURE also shows various exemplary inductive heating units in the fuser assembly. For example, the FIGURE shows an inductive heating unit 25 adjacent the fuser roll 1, an inductive heating unit 27 adjacent release agent delivery roll 19, and an inductive heating unit 26 adjacent pressure roll 8. However, it will be understood that embodiments of the disclosure do not require all of these inductive heating units. Rather, suitable fixing and fusing can be achieved using one, two, or all three, or even more, of the inductive heating units appropriately located adjacent the respective rollers, belts, and the like.

In the embodiment shown in the FIGURE for applying the polymeric release agent 22 to outer surface 2, two release agent delivery rolls 17 and 19 rotatably mounted in the direction indicated are provided to transport release agent 22 from the sump 20 to the fuser roll surface. As illustrated, roll 17 is partly immersed in the sump 20 and transports on its surface release agent from the sump to the delivery roll 19. By using a metering blade 24, a layer of polymeric release fluid can be applied initially to delivery roll 19 and subsequently to the outer surface 2 of the fuser roll 1 in controlled thickness ranging from submicrometer thickness to thickness of several micrometers of release fluid. Thus, by metering device 24 about 0.1 to 2 micrometers or greater thickness of release fluid can be applied to the surface of fuser roll 1.

Of course, it will be appreciate that the design illustrated in the FIGURE is not limiting to the present disclosure. For example, other well known and after developed development apparatus can also accommodate and use the fuser and fixer members described herein. For example, the development apparatus in embodiments does not require the application of release agent to the fuser roll surface, and thus the release agent components can be omitted. In other embodiments, the depicted cylindrical fuser roll can be replaced by an endless belt fuser member. In still other embodiments, the heating of the fuser member can be by other methods than the specifically depicted inductive heating element, such as by alternatively locating the inductive heating element with respect to the fuser member. Other changes and modification will be apparent to those in the art.

As used herein, the term "fuser" or "fixing" member, and variants thereof, may be a roll, belt such as an endless belt, flat surface such as a sheet or plate, or other suitable shape used in the fixing of thermoplastic toner images to a suitable substrate. It may take the form of a fuser member, a fixing member, a pressure member, or a release agent donor member preferably in the form of a cylindrical roll. Typically, the fuser member is made of a hollow cylindrical metal core, such as copper, aluminum, steel and the like, and has an outer layer of the selected elastomer or fluoroelastomer. Alternatively, there may be one or more intermediate layers between the substrate and the outer layer of the elastomer, if desired. Typical materials having the appropriate thermal and mechanical properties for such layers include silicone elastomers, fluoroelastomers, EPDM (ethylene propylene hexadiene), and Teflon™ (i.e., polytetrafluoroethylene) such as Teflon PFA sleeved rollers.

In embodiments, the fuser member is comprised of a core, such as metals, with a coating, usually continuous, of a thermally conductive and resilient compressible material that preferably has a high thermomechanical strength. Various designs for fusing and fixing members are known in the art and are described in, for example, U.S. Pat. Nos. 4,373,239, 5,501,881, 5,512,409 and 5,729,813, the entire disclosures of which are incorporated herein by reference.

Generally, the core can include any suitable supporting material, around or on which the subsequent layer(s) are formed. Suitable core materials include, but are not limited to, metals such as aluminum, anodized aluminum, steel, nickel, copper, and the like. If desired, the core material can also be selected to be a polymeric material, such as polyimide, polyether ether ketone (PEEK), Teflon/PFA, and the like, which can be optionally filed with fiber such as glass, and the like. In embodiments, a polymeric or other core material may be desired that does not conduct. In addition, other materials that do not conduct the generated heat away from the surface layers include, but are not limited to, ceramic rolls and the like.

A coating, which is preferably of a thermally conductive and resilient compressible material, is then applied to the core member. The coating can be any suitable material including, but not limited to, any suitable thermally conductive fluoropolymer, elastomer, or silicone material. In embodiments, the coating material can be either partial or completely thermally conductive itself, or the thermal conductivity can be provided by incorporation of the ferromagnetic or magnetic particles, as described below. In either case, the coating material includes the described ferromagnetic or magnetic particles to enable induction heating of the coating. Generally, the coating material must be a heat stable elastomer or resin material that can withstand elevated temperatures generally from about 90° C. up to about 200° C. or higher, depending upon the temperature desired for fusing or fixing the toner particles to the substrate. The coating material used in the fuser or fixing member must also generally not be degraded by any release agent that may be applied to the member, which is used to promote release of the molten or tackified toner from the member surface.

Suitable fluoropolymers include fluoroelastomers and fluororesins. Examples of suitable fluoroelastomers include, but are not limited to, i) copolymers of vinylidenefluoride and hexafluoropropylene; ii) terpolymers of vinylidenefluoride, hexafluoropropylene and tetrafluoroethylene; and iii) tetrapolymers of vinylidenefluoride, hexafluoropropylene, tetrafluoroethylene and a cure site monomer. For example, specifically, suitable fluoropolymers are those described in detail in U.S. Pat. Nos. 5,166,031, 5,281,506, 5,366,772, 5,370,931, 4,257,699, 5,017,432 and 5,061,965, the entire disclosures each of which are incorporated by reference herein in their entirety. As described therein these fluoropolymers, particularly from the class of copolymers of vinylidenefluoride and hexafluoropropylene; terpolymers of vinylidenefluoride, hexafluoropropylene and tetrafluoroethylene; and tetrapolymers of vinylidenefluoride, hexafluoropropylene, tetrafluoroethylene and cure site monomer, are known commercially under various designations as VITON A®, VITON E®, VITON E 60C®, VITON E430®, VITON 910®, VITON GH® and VITON GF®. The VITON® designation is a Trademark of E.I. DuPont de Nemours, Inc. The cure site monomer can be, for example, 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS® a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, and TN505®, available from Montedison Specialty Chemical Company.

Other fluoropolymers useful in the present disclosure include polytetrafluoroethylene (PTFE), fluorinated ethylenepropylene copolymer (FEP), polyfluoroalkoxypolytetrafluoroethylene (PFA Teflon) and the like.

Preferred fluoropolymers useful for the surface of fuser members in the present disclosure include fluoroelastomers, such as fluoroelastomers of vinylidenefluoride based fluoroelastomers, which contain hexafluoropropylene and tetrafluoroethylene as comonomers. Three preferred known fluoroelastomers are (1) a class of copolymers of vinylidenefluoride and hexafluoropropylene known commercially as VITON A® (2) a class of terpolymers of vinylidenefluoride, hexafluoropropylene and tetrafluoroethylene known commercially as VITON B® and (3) a class of tetrapolymers of vinylidenefluoride, hexafluoropropylene, tetrafluoroethylene and cure site monomer known commercially as VITON GH® or VITON GF®. VITON A®, VITON B®, VITON GH®, VITON GF® and other VITON® designations are trademarks of E.I. DuPont de Nemours and Company. The fluoroelastomers VITON GH® and VITON GF® available from E.I. DuPont de Nemours Inc., have a preferred embodiment of relatively low amounts of vinylidenefluoride. The VITON GF® and Viton GH® have 35 weight percent of vinylidenefluoride, 34 weight percent of hexafluoropropylene and 29 weight percent of tetrafluoroethylene with 2 weight percent cure site monomer. In a further preferred embodiment, the fluoropolymer is PFA Teflon, FEP, PTFE, VITON GF® or VITON GH®. In a particularly preferred embodiment, the fluoropolymer is PFA Teflon, VITON GF® or VITON GH®.

Examples of suitable elastomer materials include, but are not limited to, organic rubbers such as ethylene/propylene diene, fortified organic rubbers that resist degradation at fusing temperatures, various copolymers, block copolymers, copolymer and elastomer blends, and the like. Any elastomer or resin preferably has thermal oxidative stability, i.e., resist thermal degradation at the operating temperature of the fuser member. Thus the organic rubbers that resist degradation at the operating temperature of the fuser member may preferably be used. These include chloroprene rubber, nitrile rubber, chlorobutyl rubber, ethylene propylene terpolymer rubber (EPDM), butadiene rubber, ethylene propylene rubber, butyl rubber, butadiene/acrylonitrile rubber, ethylene acrylic rubber, sytrene/butadiene rubber, phosphazene, and the like or the foregoing rubbers fortified with additives that thermally stabilize the rubber at least at the operating temperature of the fuser member.

Examples of suitable silicone materials include, but are not limited to, silicone rubber, fluorosilicones, siloxanes, and the like. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; and 106 RTV Silicone Rubber and 90 RTV Silicone Rubber, both from General Electric. Further examples of silicone materials include Dow Coming SILASTIC® 590 and 591, Sylgard 182, and Dow Coming 806A Resin. Other preferred silicone materials include fluorosilicones such as nonylfluorohexyl and fluorosiloxanes such as DC94003 and Q5-8601, both available from Dow Corning. Silicone conformable coatings such as X3-6765 available from Dow Corning. Other suitable silicone materials include the siloxanes (preferably polydimethylsiloxanes) such as, fluorosilicones, dimethylsilicones, liquid silicone rubbers such as vinyl crosslinked heat curable rubbers or silanol room temperature crosslinked materials, and the like. Suitable silicone rubbers are available also from Wacker Silicones.

The above coating materials, and others, can be used in the exterior surface layer of the members, or they can be used in intermediate layers, as desired. Adhesive materials can also be incorporated, as necessary or desired.

In addition to the above, suitable materials that may be used to form the coating layer include hybrid elastomers of the above and other materials, such as mixtures, blends or interpenetrating materials of two or more of fluoropolymer, silicone and elastomer. Also suitable are mixtures of fluororesin particles, such as PTFE powder, and one or more elastomers.

The coating can be applied to the core member by any suitable method known in the art. Such methods include, but are not limited to, spraying, dipping, flow coating, casting or molding. Typically the surface layer of the fuser member is from about 4 to about 9 mils and preferably 6 mils in thickness, as a balance between conformability and cost and to provide thickness manufacturing latitude.

In embodiments, in addition to the core member and the outer coating layer, the fuser or other members may also optionally include one or more thermally conductive intermediate layers between the substrate and the outer layer of the cured elastomer, if desired. Such intermediate layers can include, for example, a primer layer, an adhesive layer, a metal oxide filler layer, and the like.

Typical materials having the appropriate thermal and mechanical properties for such intermediate layers include thermally conductive (e.g., 0.59 $Wm^{-1}K^{-1}$) silicone elastomers such as high temperature vulcanizable ("HTV") materials, liquid silicone rubbers ("LSR") and room temperature vulcanizable ("RTV"), which may optionally include filler materials such as an alumina filler. The silicone elastomer may have a thickness of about 2 to 10 mm (radius). An HTV is either a plain polydimethyl siloxane ("PDMS"), with only methyl substituents on the chain, $(OSi(CH_3)_2)$ or a similar material with some vinyl groups on the chain $(OSi(CH{=}CH_2)(CH_3))$. Either material is peroxide cured to create crosslinking. An LSR usually consists of two types of PDMS chains, one with some vinyl substituents and the other with some hydride substituents. They are kept separate until they are mixed just prior to molding. A catalyst in one of the components leads to the addition of the hydride group $(OSiH(CH_3))$ in one type of chain to the vinyl group in the other type of chain causing crosslinking.

To promote adhesion between the fuser member core and the fluoroelastomer surface layer, an adhesive, and in particular a silane adhesive, such as described in U.S. Pat. No. 5,049,444, the entire disclosure of which is incorporated herein by reference, which includes a copolymer of vinylidenefluoride, hexafluoropropylene and at least 20 percent by weight of a coupling agent that comprises at least one organo functional silane and an activator, may be used. In addition, for the higher molecular weight hydrofluoroelastomers such as, for example, Viton GF, the adhesive may be formed from the FKM hydrofluoroelastomer in a solvent solution together with an amino silane represented by the formula as described in U.S. Pat. No. 5,332,641, the entire disclosure of which is incorporated herein by reference. Such adhesive layers are optional, and need not be incorporated in all embodiments.

To enable inductive heating of the fuser member, an appropriate type and amount of ferromagnetic or magnetic particles are included as a filler material in at least one layer of the fuser member. As desired, the ferromagnetic or magnetic particles can be incorporated directly into the surface layer to provide direct heating of that layer, or they can be incorporated into one or more intermediate layers or even into a core (substrate or base) layer of the fuser member.

As the ferromagnetic or magnetic particles, any of the currently known or after-developed ferromagnetic or magnetic particles can be used. Thus, for example, the particles can be ferromagnetic particles, Rare earth transition metal alloys, metals and alloys thereof, mixtures thereof, and the like. Examples of suitable ferromagnetic or magnetic particles include, but are not limited to, barium ferrite powder ($BaO.6Fe_2O_3$), strontium ferrite powder ($SrO.6Fe_2O_3$), barium-strontium ferrite powder ($Ba_xSr_{1-x}$. $6Fe_2O_3$), $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, alloys of 33Ne 66Fe 1B, an Nd—Fe—B-ba quenched magnetic powder (such as the product MQP-B manufactured by GM), ferrite particles, Co—Zn ferrites such as $Co_{(1-a)}Zn_aFe_2O_4$ where a can range from 0 to 1 such as from about 0.05 to about 0.8 or from about 0.1 to about 0.7,Mg—Zn ferrites, $Mn_{(1-a)}Zn_aFe_2O_4$ where a can range from 0 to 1 such as from about 0.1 to about 0.7 or from about 0.2 to about 0.6, $Ni_{(1-a)}Zn_aFe_2O_4$ where a can range from 0 to 1 such as from about 0.3 to about 0.8 or from about 0.42 to about 0.72, $Co_{(1-a)}Zn_aBa_2Fe_{12}O_{22}$ where a can from 0 to 1 such as from about 0.1 to about 0.9 or from about 0.2 to about 0.8, $Ni_{(1-a)}Zn_aBa_2Fe_{12}O_{22}$ where a can range from 0 to 1 such as from about 0.1 to about 0.9 or from about 0.2 to about 0.8, $Mn_{(1-a)}Zn_aBa_2Fe_{12}O_{22}$ where a can range from 0 to 1 such as from about 0.1 to about 0.9 or from about 0.2 to about 0.8, $Mg_{(1-a)}Zn_aBa_2Fe_{12}O_{22}$ where a can range from 0 to 1 such as from about 0.1 to about 0.9 or from about 0.2 to about 0.8, $YFe_5O_{12}$, $SmFe_5O_{12}$, $EuFe_5O_{12}$, $GdFe_5O_{12}$, $TbFe_5O_{12}$, $DyFe_5O_{12}$, Ho $Fe_5O_{12}$, Er $Fe_5O_{12}$, $TmFe_5O_{12}$, $YbFe_5O_{12}$, $LuFe_5O_{12}$, mixtures thereof, and the like. Examples of suitable Rare earth transition metal alloys include, but are not limited to, amorphous $GdFe_2$, amorphous $GdFe_3$, amorphous $GdCo_2$, crystalline $TbCo_3$, crystalline $DyCo_3$, crystalline $HoCo_3$, and the like. Examples of suitable metal and alloys include, but are not limited to, purified iron, iron, 45 Permalloy, Hipemik, Monimax, 78 Permalloy, Mumetal, Supermalloy, Permendur, Hiperco, Ferroxcube, and the like. Any other suitable magnet material can also be used.

Specific examples of suitable ferrite particles include, but are not limited to, BG-12, available from Kane Magnetics; HM 170, available from Hoosier Magnetics; and FM 201, available from Toda America, Inc. In addition, any of the above-described magnet powder materials used to form the bulk material may also be used. Thus, the other examples of suitable ferrite particles include, but are not limited to, barium ferrite powder ($BaO.6Fe_2O_3$), strontium ferrite powder ($SrO.6Fe_2O_3$), barium-strontium ferrite powder ($Ba_xSr_{1-x}$ $O.6Fe_2O_3$), $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, alloys of 33Ne 66Fe 1B, an Nd—Fe—B-based quenched magnetic powder (such as the product MQP-B manufactured by GM), ferrite particles, and the like.

In preferred embodiments, the ferromagnetic particles are Co—Zn ferrites and/or Mg—Zn ferrites. In such compositions, the relative amounts of Co or Mg and Zn can be varied, to provide materials with different desired properties.

For example, it is known that such particles exhibit Curie temperature, i.e., where heat generation is active at a temperature below the Curie temperature but is essentially "turned off" at a temperature above the Curie temperature. Thus, for example, such particles can be used to provide heating of the fuser member to a desired, self-regulated temperature. In these materials, the induction heating causes the ferromagnetic particles to rapidly heat up. However, as the temperature approaches the Curie temperature, the heating decreases, such that the particles essentially attain and remain at a steady state temperature. Further inductive heating does not further raise the particle temperature, but only maintains it at about the curie temperature.

This phenomenon allows the ferromagnetic particle composition to be tailored such that a set Curie temperature can be provided, to in turn provide a target, maximum fuser member hearing temperature. For example, the following Table shows how variation in the particle composition can vary the Curie temperature:

| Co—Zn Ferrites | | Mg—Zn Ferrites | |
|---|---|---|---|
| Zn content | Curie Temp. | Zn content | Curie Temp. |
| 0 | 320 | 0 | 260 |
| 25 | 261 | 25 | 208 |
| 50 | 205 | 50 | 170 |
| 75 | 152 | 75 | 130 |
| 100 | 98 | | |

Similar Curie temperature variation based on ferrite composition variation is also observed for other ferromagnetic materials.

Accordingly, where ferromagnetic material exhibits such Curie temperature, it is preferred that the ferromagnetic material composition, and its corresponding Curie temperature, be selected to correspond to the desired maximum heating temperature of the fuser member. Preferred ferromagnetic materials accordingly have a Curie temperature of from about 40° C. to about 400° C., such as from about 60° to about 240° C. Thus, for example, a Co—Zn ferrite having 50% Zn can be selected to provide a Curie temperature, and desired maximum heating temperature of the fuser member, of about 205° C., while a Mg—Zn ferrite having 25% Zn can be selected to provide a Curie temperature, and desired maximum heating temperature of the fuser member, of about 208° C.

In embodiments, the ferromagnetic or magnetic materials can have any suitable or desirable particle size. For example, suitable particle sizes can range from as small as 0.001 micron or less, to as large as 100 microns or more. However, use of particle having an average particle size in the nanometer range is preferred, in some embodiments. For example, ferromagnetic or magnetic materials having an average particle size of from about 10 to about 3500 nanometers, such as from about 10 to about 1000 or from about 50 to about 500 nanometers, are preferred. Generally, such nanometer-sized particles are preferred because they provide a large surface/volume ratio for conducting the heat generated away from the particles, and a short heat conduction path between particles thereby providing fast iso-thermalization. Of course, smaller or larger sized particles can be used, in embodiments.

The ferromagnetic or magnetic materials can be incorporated as a filler into the selected fuser member layer in any desirable and effective amount. For example, a suitable loading amount can range from about 0.1 or from about 0.2 volume percent, to as high as about 35 or about 45 volume percent or more. However, loading amounts of from about 1 or from about 5 to about 25 or about 35 volume percent may be desired in some embodiments. In one embodiment, a loading amounts of from about 5 to about 30 volume percent is desired.

To improve performance and avoid compositional changes over time, it is also possible to coat the ferromagnetic or magnetic materials with a thin polymer coating. That is, small ferrite particles of large surface area are subject to fast oxidation. This oxidation generates a thin oxidized layer around the particles that is inactivated. However, the oxidation and its effect can be avoided by using ferromagnetic or magnetic materials that have a thin coating, such as polymeric coating, on the particle surface.

An inorganic particulate filler may be, and usually is, used in connection with the outer layer of the fuser member. Such fillers may also be incorporated in any optional intermediate layers of the fuser member, if desired. The inorganic particulate filler, in embodiments, increases the abrasion resistance of the outer layer, and provide increased thermal conductivity to the layer. The inorganic particulate filler may be dispersed in the layer coating composition in any suitable manner, but in preferred embodiments, the inorganic particulate filler is uniformly dispersed throughout the layer, coating or body, and in a particularly preferred embodiment, is also present on the surface of the outer layer. Preferred fillers include a metal-containing filler, such as a metal, metal alloy, metal oxide, metal salt or other metal compound. The general classes of metals that are applicable to the present disclosure include those metals of Groups 1b, 2a, 2b, 3a, 3b, 4a, 4b, 5a, 5b, 6b, 7b, 8 and the rare earth elements of the Periodic T Preferably, the filler is an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel and alloys thereof. The particularly preferred inorganic particulate fillers are aluminum oxide and cupric oxide. Preferred fillers also include reinforcing and non-reinforcing calcined alumina and tabular alumina respectively.

The inorganic particulate filler may be present in the coating layer in an amount sufficient to provide the desired abrasion resistance and thermal conductivity. For example, a suitable loading amount can range from about 0.5 or from about 1 weight percent, to as high as about 50 or about 60 weight percent or more. However, loading amounts of from about 1 or from about 5 to about 20 or about 30 weight percent may be desired in some embodiments.

The particle size of the filler dispersed in the polymer generally ranges from about 1 to about 9 micrometers, preferably from about 1 to about 3 micrometers. However, smaller or larger sizes can be used, in embodiments.

Once the desired layers are applied to the core member, the elastomer materials are cured. Any of the various curing methods known in the art can be used, such as convection oven drying, radiant heat drying, and the like.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

A coated fuser roll is made by coating a layer of TEFLON® (polytetrafluoroethylene) on a metallic substrate. The fuser roll substrate is a cylindrical aluminum fuser roll core about 3 inches in diameter and 16 inches long, which is degreased, grit blasted, degreased and covered with a silane adhesive as described in U.S. Pat. No. 5,332,641, the entire disclosure of which is incorporated herein by reference.

The elastomer layer is prepared from a solvent solution/dispersion containing TEFLON® polymer, and loaded with 20 weight % Co—Zn ferrite having 50% by weight Zn. The solution is sprayed upon the 3 inch cylindrical roll to a nominal thickness of about 10–12 mils. The coated fuser member is then cured in a convection oven.

The result is a fuser member that can be inductively heated to a steady-state, self-regulating temperature of about 205° C.

Examples 2–4

Fuser rolls are prepared as in Example 1 above, except that the TEFLON® polymer is replaced by polyfluoroalkoxypolytetrafluoroethylene (PFA Teflon), fluorinated ethylenepropylene copolymer (FEP), or Teflon AF 2400. The results are fuser members that can be inductively heated to a steady-state, self-regulating temperature of about 205° C.

Examples 5–8

Fuser rolls are prepared as in Examples 1–4 above, except that the Co—Zn ferrite is replaced by a similar amount of Mg—Zn ferrite having 25% by weight Zn. The results are fuser members that can be inductively heated to a steady-state, self-regulating temperature of about 208° C.

Example 9

A coated fuser roll is made by coating a layer of VITON GF® on a metallic substrate. The fuser roll substrate is a cylindrical aluminum fuser roll core about 3 inches in diameter and 16 inches long, which is degreased, grit blasted, degreased and covered with a silane adhesive as described in U.S. Pat. No. 5,332,641, the entire disclosure of which is incorporated herein by reference.

The elastomer layer is prepared from a solvent solution/dispersion containing VITON GF® polymer, and loaded with 20 weight % Co—Zn ferrite having 50% by weight Zn. The solution is sprayed upon the 3 inch cylindrical roll to a nominal thickness of about 10–12 mils. The coated fuser member is then cured in a convection oven.

The result is a fuser member that can be inductively heated to a steady-state, self-regulating temperature of about 205° C.

Examples 10–13

Fuser rolls are prepared as in Example 9 above, except that the VITON GF® polymer is replaced by VITON B50®, VITON E45®, silicone rubber, or EPDM (ethylene propylene hexadiene) rubber. The results are fuser members that can be inductively heated to a steady-state, self-regulating temperature of about 205° C.

Examples 14–18

Fuser rolls are prepared as in Examples 9–13 above, except that the Co—Zn ferrite is replaced by a similar amount of Mg—Zn ferrite having 25% by weight Zn. The results are fuser members that can be inductively heated to a steady-state, self-regulating temperature of about 208° C.

What is claimed is:

1. An apparatus comprising:

a fuser roll;

a pressure roll;

a release agent delivery roll, wherein at least one of the fuser roll, pressure roll and release agent delivery roll is a coated member comprising:

a substrate; and a coating layer over said substrate, wherein said coating layer comprises at least one of ferromagnetic and magnetic particles dispersed in a binder; and at least one separate inductive heater assembly placed adjacent to each of the fuser roll, pressure roll and release agent delivery roll for inductively heating the at least one of ferromagnetic and magnetic particles.

2. The apparatus of claim 1, wherein said binder is selected from the group consisting of fluoropolymer, elastomer, silicone materials, mixtures thereof, and hybrid elastomers thereof.

3. The apparatus of claim 2, wherein the substrate is formed of a material selected from the group consisting of aluminum, anodized aluminum, steel, nickel, copper, and mixtures thereof.

4. The apparatus of claim 1, wherein said binder is a fluoropolymer selected from the group consisting of fluoroelastomers and fluororesins.

5. The apparatus of claim 1, wherein said binder is an elastomer selected from the group consisting of organic rubbers, fortified organic rubbers, copolymers, and copolymer and elastomer blends.

6. The apparatus of claim 1, wherein said binder is a silicone selected from the group consisting of silicone rubber, fluorosilicones, and siloxanes.

7. The apparatus of claim 1, wherein said substrate is a metallic substrate.

8. The apparatus of claim 1, wherein said substrate is in a form of a hollow cylinder, a belt or a sheet.

9. The apparatus of claim 1, wherein said coating layer further comprises a metal oxide filler.

10. The apparatus of claim 1, wherein said at least one of ferromagnetic and magnetic particles are ferromagnetic particles exhibiting a Curie temperature of from about 40° to about 230° C.

11. The apparatus of claim 1, wherein said at least one of ferromagnetic and magnetic particles can be induction heated.

12. The apparatus of claim 1, wherein said at least one of ferromagnetic and magnetic particles are selected from the group consisting of ferromagnetic particles, Rare earth transition metal alloys, metals and alloys thereof, and mixtures thereof.

13. The apparatus of claim 1, wherein said at least one of ferromagnetic and magnetic particles are selected from the group consisting of barium ferrite powder, strontium ferrite powder, barium-strontium ferrite powder, $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, alloys of 33Ne 66Fe 1B, Nd—Fe—B-based quenched magnetic powder, ferrite particles, Co—Zn ferrites, Mg—Zn ferrites, $Mn_{(1-a)}Zn_aFe_2O_4$ where a can range from 0 to 1, $Ni_{(1-a)}Zn_aFe_2O_4$ where a can range from 0 to 1, $Co_{(1-a)}Zn_aBa_2Fe_{12}O_{22}$ where a can range from 0 to 1, $Ni_{(1-a)}Zn_aBa_2Fe_{12}O_{22}$ where a can range from 0 to 1, $Mn_{(1-a)}Zn_aBa_2Fe_{12}O_{22}$ where a can range from 0 to 1, $Mg_{(1-a)}Zn_aBa_2Fe_{12}O_{22}$ where a can range from 0 to 1, $YFe_5O_{12}$, Sm $Fe_5O_{12}$, Eu $Fe_5O_{12}$, Gd $Fe_5O_{12}$, Tb $Fe_5O_{12}$, Dy $Fe_5O_{12}$, Ho $Fe_5O_{12}$, Er $Fe_5O_{12}$, Tm $Fe_5O_{12}$, Yb $Fe_5O_{12}$, Lu $Fe_5O_{12}$, amorphous $GdFe_2$, amorphous $GdFe_3$, amorphous $GdCo_2$, crystalline $TbCo_3$, crystalline $DyCo_3$, crystalline $HoCo_3$, purified iron, iron, 45 Permalloy, Hipernik, Monimax, 78 Permalloy, Mumetal, Supermalloy, Permendur, Hiperco, Ferroxcube, and mixtures thereof.

14. The apparatus of claim 1, wherein said at least one of ferromagnetic and magnetic particles are selected from the group consisting of Co—Zn ferrites and Mg—Zn ferrites.

15. The apparatus of claim 1, wherein said at least one of ferromagnetic and magnetic particles have an average particle size of from about 1 to about 5000 nanometers.

16. The apparatus of claim 1, wherein the coated member is a member, suitable for use in an electrostatographic printing process, selected from the group consisting of a fuser member, a fixing member, a pressure roller, and release agent donor member.

17. The apparatus of claim 1, wherein said at least one of ferromagnetic and magnetic particles are core particles coated with a polymeric coating.

* * * * *